US008944588B2

(12) United States Patent
Herrmann et al.

(10) Patent No.: US 8,944,588 B2
(45) Date of Patent: Feb. 3, 2015

(54) PNEUMATIC SHEET REGISTRATION AND CLAMPING WITH VECTORED AIR FLOW

(71) Applicant: Xerox Corporation, Norwalk, CT (US)

(72) Inventors: Douglas K. Herrmann, Webster, NY (US); James Joseph Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 23 days.

(21) Appl. No.: 13/796,872

(22) Filed: Mar. 12, 2013

(65) Prior Publication Data

US 2014/0267523 A1 Sep. 18, 2014

(51) Int. Cl.
*B41J 13/26* (2006.01)

(52) U.S. Cl.
CPC ..... *B41J 13/26* (2013.01)
USPC ..... 347/104

(58) Field of Classification Search
CPC ..... B41F 1/28; B41F 21/00; B41J 3/28; B41J 11/0065; B41J 11/007; B41J 11/0085; B41J 11/0095; B41J 11/06; B41J 13/103; B41J 13/14; B65G 51/03; B65H 5/228; B65H 9/00; B65H 9/06; B65H 9/106; B65H 9/166; B65H 29/245; B65H 2801/21; B65H 2301/4212
USPC ..... 347/104; 271/194, 195, 236; 400/578
See application file for complete search history.

(56) References Cited

U.S. PATENT DOCUMENTS

| | | | | |
|---|---|---|---|---|
| 4,066,254 | A * | 1/1978 | Stange et al. | 271/236 |
| 8,579,284 | B2 * | 11/2013 | Herrmann et al. | 271/236 |
| 2002/0003333 | A1 * | 1/2002 | Henn et al. | 271/226 |
| 2003/0085979 | A1 * | 5/2003 | Ishii et al. | 347/104 |

* cited by examiner

*Primary Examiner* — Manish S Shah
*Assistant Examiner* — Roger W Pisha, II
(74) *Attorney, Agent, or Firm* — Hoffmann & Baron, LLP

(57) ABSTRACT

A pneumatic table for registering and clamping thereon a sheet of substrate media for handling in a printing system including a media platen having a foraminous upper surface for receiving media. A first reversible air blower is in fluid communication with the media platen and selectively generates at least one of a positive air flow and a negative airflow through the upper surface. The positive air flow forms a gaseous layer of air between the upper surface and the media. The negative airflow fixes the media to the upper surface. A registration wall extends along an edge of the upper surface. A sheet biasing element selectively applies a biasing force to the media to move the media toward the registration wall.

18 Claims, 5 Drawing Sheets

PNEUMATIC SHEET REGISTRATION AND CLAMPING WITH VECTORED AIR FLOW

TECHNICAL FIELD

The present disclosure relates to an apparatus for and method of registering and clamping sheets of substrate media transported on a moveable platen in a printing system.

BACKGROUND

High speed inkjet marking devices for large sized cut sheets are particularly constrained using contemporary systems with regard to production output, media type and image quality. Systems that handle such large sized cut sheets can use an oversized media platen to support the sheet during the marking process, but placement and registration of the sheet on the platen requires precision. Also, once the sheet is moved into the desired registration position, that position must be reliability maintained. However, such large sheets are particularly difficult to manipulate into and maintain in proper registration upon the platen, particularly if it is a moveable platen.

Accordingly, it would be desirable to provide an apparatus for and method of registering and clamping a sheet of substrate media on a media platen for handling in a printing system that overcomes the various shortcomings of the prior art.

SUMMARY

According to aspects described herein, there is disclosed a pneumatic table for registering and clamping thereon a sheet of substrate media for handling in a printing system. The pneumatic table includes a media platen having a foraminous upper surface for receiving a substrate media sheet. A first reversible air blower is in fluid communication with the media platen and selectively generates at least one of a positive air flow and a negative airflow through the foraminous upper surface. The positive air flow forms a gaseous layer of air between the foraminous upper surface and the substrate media sheet. The negative airflow encourages the substrate media sheet to remain fixed and engaged upon the foraminous upper surface. A registration wall extends along at least one edge of the foraminous upper surface. A sheet biasing element includes a directionally vectored positive air flow. The sheet biasing device selectively applies a biasing force to the substrate media sheet encouraging movement of the substrate media sheet across the foraminous upper surface for engaging the substrate media sheet with the registration wall.

Additionally, the reversible air blower can be configured to provide a virtually instantaneous transition from positive air flow to negative air flow. Alternatively, the reversible air blower can be configured to provide a progressive transition across the foraminous upper surface from positive air flow to negative air flow. The pneumatic table can further include an edge sensor for detecting a position of the substrate media sheet. The edge sensor disposed along a portion of the registration wall for detecting the substrate media sheet has attained a target registration position. The registration wall can extend along two adjoining edges of the foraminous upper surface. The registration wall can also extend continuously along the at least one edge substantially as long as at least one edge of the substrate media sheet. At least a portion of the registration wall can be selectively moveable in order to allow the substrate media sheet to slide off the foraminous upper surface.

According to further aspects described herein, there is disclosed a method of registering and securing a sheet of substrate media on a media platen for handling in a printing system, the method including loading a substrate media sheet onto a media platen, the media platen including a foraminous upper surface for engaging the substrate media sheet; generating a positive flow of air through the foraminous upper surface, the positive flow of air forming a gaseous layer of air between the foraminous upper surface and the substrate media sheet; applying a generally biasing force to the substrate media sheet at least partially suspended on the gaseous layer, the biasing force including a directionally vectored positive air flow passing through the media platen; and generating a negative flow of air through the foraminous upper surface, the negative flow of air encouraging the substrate media sheet to remain fixed and engaged upon the foraminous upper surface.

Additionally, the negative flow of air can be generated in response to the positive flow of air no longer passing through at least a portion of the foraminous upper surface that previously had the positive flow of air passing therethrough. Also, a virtually instantaneous transition can be provided from the generation of the positive flow of air to the generation of the negative flow of air. A progressive transition across the foraminous upper surface can alternatively be provided from the generation of the positive flow of air to the generation of the negative flow of air. The negative flow of air can be generated in response to an indication by a sensor that the substrate media sheet has engaged a registration wall extending along at least one edge of the foraminous upper surface. The registration wall engagement can include the substrate media engaging two extents of the registration wall. The two extents of the registration wall can be disposed along two adjoining edges of the foraminous upper surface.

DETAILED DESCRIPTION

Figure 1:
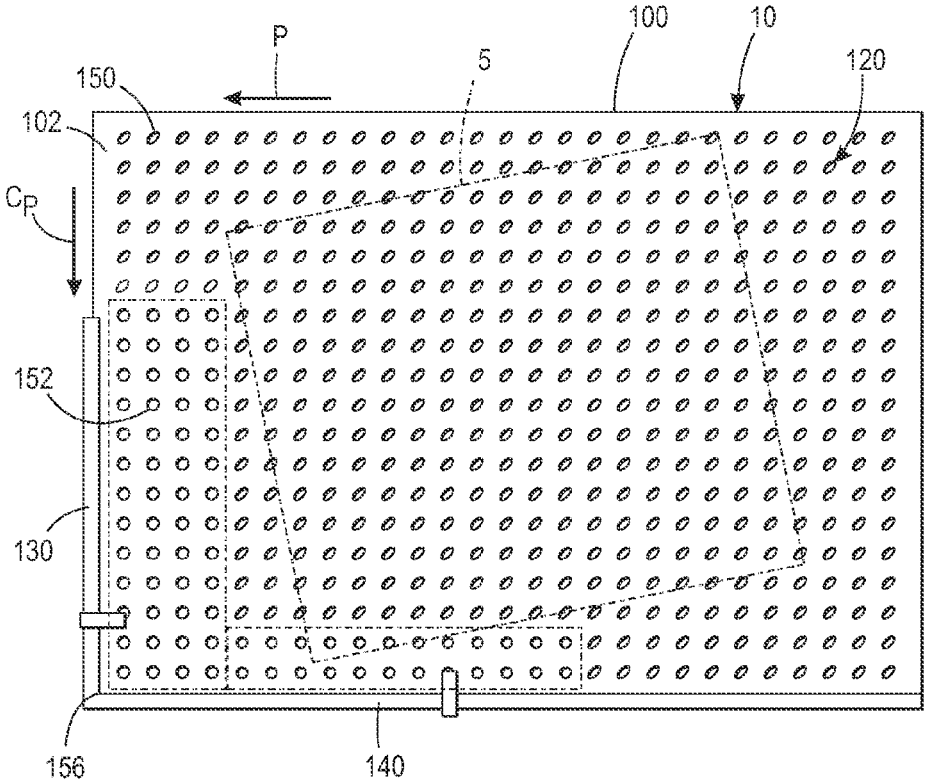
FIG. 1 is a plan view of a pneumatic table for registering and transporting a skewed sheet of substrate media being biased toward a registration corner in accordance with an aspect of the disclosed technologies.

Describing now in further detail these exemplary embodiments with reference to the Figures. The disclosed technologies improve image quality for large format print jobs, while providing an efficient sheet registration and handling system that can improve productivity. The apparatus and methods disclosed herein can be used in a select location or multiple locations of a marking device path that includes a pneumatic table. Thus, only a portion of an exemplary pneumatic table and methods of use thereof are illustrated herein.

As used herein, "substrate media sheet", "substrate media" or "sheet" refers to a substrate onto which an image can be imparted. Such substrates may include, paper, transparencies, parchment, film, fabric, plastic, photo-finishing papers, corrugated board, or other coated or non-coated substrate media upon which information or markings can be visualized and/or reproduced. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in a process direction.

As used herein, "sensor" refers to a device that responds to a physical stimulus and transmits a resulting impulse in the form of a signal for the measurement and/or operation of controls. Such sensors include those that use pressure, light, motion, heat, sound and magnetism. Also, each of such sensors as refers to herein can include one or more sensors for detecting and/or measuring characteristics of a substrate media, such as speed, orientation, process or cross-process position and even the size of the substrate media. Thus, reference herein to a "sensor" can include more than one sensor.

As used herein, "marking zone" refers to the location in a substrate media processing path in which the substrate media is altered by a "marking device." Marking devices as used herein include a printer, a printing assembly or printing system. Such marking devices can use digital copying, bookmaking, folding, stamping, facsimile, multi-function machine, and similar technologies. Particularly those that perform a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, the term "foraminous surface" refers to a surface having a plurality or holes therein. The surface may be perforated, porous, or otherwise include numerous holes. The holes may allow the passage of air there through.

As used herein, the terms "process" and "process direction" refer to a process of moving, transporting and/or handling a substrate media sheet. The process direction substantially coincides with a direction of a flow path P along which a portion of the media sled moves and/or which the image or substrate media is primarily moved within the media handling assembly. Such a flow path P is said to flow from upstream to downstream. Accordingly, cross-process, lateral and transverse directions refers to movements or directions perpendicular to the process direction and generally along a common planar extent thereof.

FIG. 1 shows a plan view of a pneumatic table 10 for registering and clamping a sheet of substrate media 5 placed thereon. When printing a sheet, such as a sheet of paper, on a media platen, precise registration of the sheet must be accomplished before the sheet can be marked or further processed. The media platen generally formed as a flat rigid plate for supporting the substrate media sheet. Generally the media platen can be a flat metal surface which will support the sheet when pressure is applied thereto, particularly as part of a printing process using marking devices.

Figure 2:
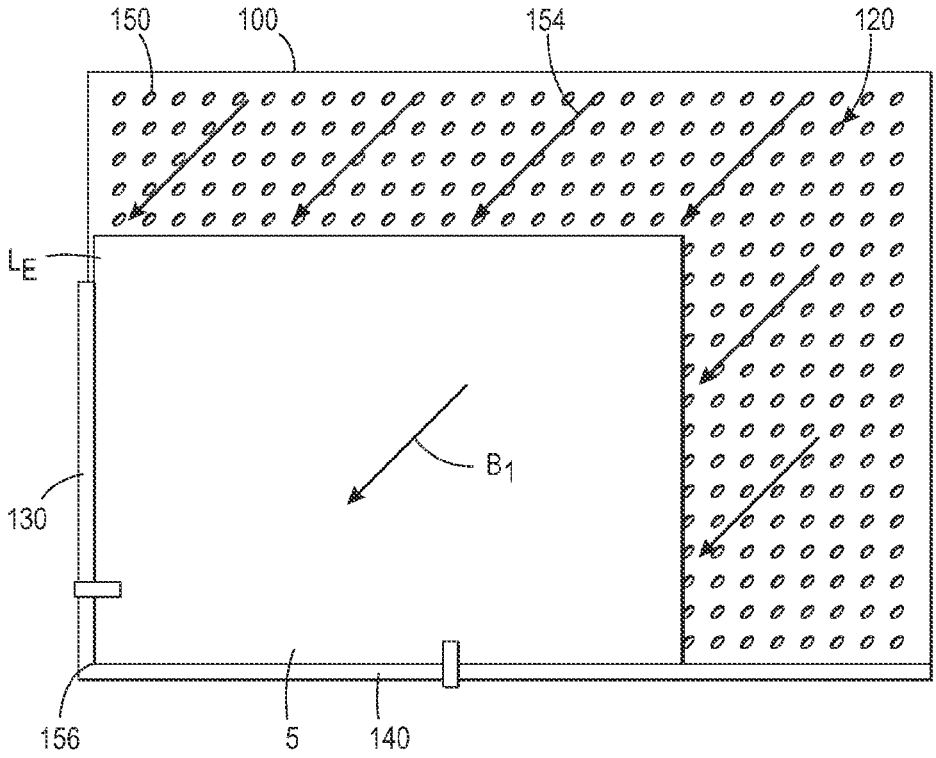
FIG. 2 is a plan view of the pneumatic table shown in FIG. 1 with a de-skewed sheet of substrate media biased into a registered orientation in accordance with an aspect of the disclosed technologies.

With additional reference to FIG. 2, the sheet 5 when placed on the platen 100 may be skewed and/or improperly positioned on the platen 100. Thus, according to an aspect of the disclosed technologies, it is desirable to have the sheet 5 properly registered relative to a process direction P as well as a cross-process direction $C_P$. A preferred registration position for the leading edge $L_E$ of the sheet 5 is when it is precisely aligned with the downstream edge of the media platen 100. That edge of the media platen 100 coincides with a side of a leading edge registration wall 130. Thus, by bringing the leading edge $L_E$ of the sheet 5 into engagement with the leading edge registration wall 130 the first part of the target registration position is achieved. Similarly, a preferred registration position for the left side lateral edge of the sheet 5 (the bottom edge as shown in the drawings) is when that sheet edge is aligned with the outboard edge of the media platen 100 (also the bottom edge as shown in the drawings). Thus, by also bringing the left lateral sheet edge into engagement with a lateral edge registration wall 140 the second part of the target registration position is achieved. The order, if any, in which these parts of the position are achieved is a matter of design choice and depends on how the sheet is moved into the target registration position. The registration walls 130 and 140 each extend above the upper surface 102 and provide an abutment surface for assisting in aligning the sheet in the registration position. At least a portion of the registration walls may be selectively moveable in order to allow the substrate media sheet to slide off the foraminous upper surface.

In accordance with a further aspect of the disclosed technologies, the pneumatic table 10 includes a media platen 100 that has a foraminous upper surface 102. The pneumatic table 10 operates by means of air, particularly compressed air, that can be expelled through the foraminous upper surface 102 or the flow reversed to create a vacuum force on the foraminous upper surface 102. The foraminous upper surface can be porous, perforated or otherwise include numerous holes so that air can be expelled from the foraminous upper surface 102 of the media platen 100. In the illustrated embodiment, the foraminous upper surface 102 includes a plurality of air holes 120 that are evenly distributed in columns and rows across the top surface of the media platen 100. It should be understood that other configurations of air holes 120 could be provided, so that fewer or greater numbers of such holes can form the foraminous upper surface. Additionally, other patterns could be formed, such as concentric arches emanating from the corner between the two registration walls 130, 140. Also, the air holes 120 need not be evenly space across the entire surface. As an alternative to the air holes 120, the foraminous upper surface 102 could be a generally porous surface with less discrete apertures. Regardless, the discrete air holes 120 or less than discrete apertures forming a porous surface are preferably in fluid communication with at least one reversible air blower that provides a source of selectively positive and/or negative air flow for the pneumatic table 10.

The air holes may have a diameter within the range of 0.5 mm to 4 mm. The surface may have air hole density of approximately 1 to 10 per square centimeter, $cm^2$. It is contemplated that the hole size and density may be varied. It is further contemplated that various hole sizes could be used on a surface and that the density of holes could vary over the surface depending on the desired air flow.

The air holes 120 may include a first set of air holes 150 and a second set of air holes 152. The first set of air holes may be angled such that the air flowing therefrom is vectored (shown by arrows 154) toward a registration corner 156. The positive air flow therefore creates a biasing force to drive the sheet against the registration walls. The first set of air holes 150 is disposed about a substantial portion of the platen. The second set of holes may include straight holes aligned substantially perpendicular to the platen upper surface 102. The second set of holes 152 may be disposed on the platen along the registration wall adjacent the leading edge of the sheet.

Figure 3:
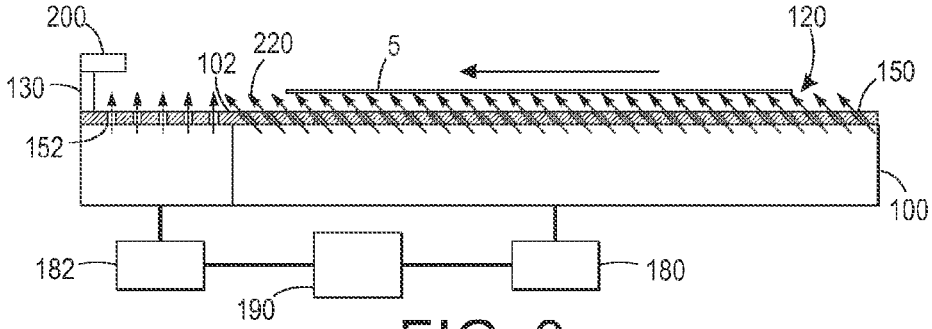
FIG. 3 is a side cross-sectional elevation view of the pneumatic table shown in FIG. 1 with positive airflow through the table in accordance with an aspect of the disclosed technologies.

With reference to FIG. 3, the first set of holes 150 may be connected to a first reversible air blower 180 that is capable of developing both a positive air flow and a negative air flow. The second set of holes 152 may be connected to a second reversible air blower 182 that is capable of developing both a positive air flow and a negative air flow. This permits the air flow to the first and second holes to be independently controlled. Accordingly, positive pressure may be simultaneously applied to the first set of holes and negative pressure applied to the second set of holes and vice versa.

FIGS. 3-6 show a side cross-sectional elevation view of the pneumatic table shown in FIGS. 1-2. These side views include a schematic representation of the first and second reversible air blowers 180 and 182, which represent any device capable of producing a current of air or gas, selectively in at least two directions. Provided appropriate tubing channels or conduits (not shown) between the air holes 120 and the first and second reversible air blowers 180 and 182 will place the air holes 120 in fluid communication with the reversible air blower 180. In this way, any air blowing from the reversible air blower will exit the air holes in the foraminous upper surface 102 or vacuum force generated will communicate a suction force on that upper surface 102.

Once a sheet 5 is placed on the pneumatic table 10, positive air flow emitted from the foraminous upper surface 102 will cause the sheet 5 to float on a gaseous layer of air formed between the upper surface 102 and the sheet 5. It should be understood that the positive air flow can be emitted before, during or after the sheet 5 is placed on the pneumatic table 10. The gaseous layer of air reduces friction or electrostatic forces that might otherwise hold the sheet 5 in a skewed or otherwise disoriented position on the platen.

In accordance with an aspect of the disclosed technologies, when the sheet 5 is floating due to the positive airflow, the vectored air flow exiting the first set of air holes 150 forms a horizontal biasing force $B_1$ that is applied to the floating sheet 5. The horizontal biasing force $B_1$ encourages the sheet 5 to move towards both upwardly standing registration walls 130, 140. Once the sheet 5 is engaged against both the leading edge registration wall 130 and the lateral edge registration wall 140, it will have attained the target registration position, as shown in FIG. 2. The registration walls 130, 140 can extend across an entire extent of each of the respective platen edges, such as the lateral wall 140 or extend across a more limited extent, such as the lead edge wall 130. Also the walls 130, 140 can be continuous solid walls or include apertures for allowing extraneous air flow to pass therethrough.

The horizontal biasing force $B_1$ will understandably have a mean directional vector. In this regard, while the direction of this initial force $B_1$ should generally be toward the corner 156 adjoining the two registration walls 130, 140, the amount of force can vary depending on factors such as the size and weight of the substrate media sheet 5.

The pneumatic table and methods described herein are particularly useful for handling large size substrate media sheets. In particular, large size paper having dimensions of 62"×42" can be easily accommodated by the disclosed technologies. What is more, larger sheets can be handled as long as the media platen 100 is sized accordingly.

Additionally, it should be understood that the pneumatic table 10 disclosed herein can be operated in conjunction with a controller 190. The controller 190 may be operably connected to the first and second reversible air blowers 180 and 182 to direct the operation and direction of air flow. The controller may also control any number of functions and systems within or associated with the pneumatic table 10 and accompanying marking systems. The controller 190 may include one or more processors and software capable of generating control signals. Through the coordinated control of the apparatus sub-elements, including the first and second reversible air blowers 180 and 182, vectored air flow and media position detection sensors 200, the substrate media sheet may be effectively handled and marked. Further, it should be understood that the controller can also operate related items such as a sheet loader for initially placing the substrate media sheet onto the pneumatic table 10. Such a sheet loader can take the form of a 6-axis adept robot system for picking and placing sheets, such as large sheets of substrate media, on the media platen 100.

The biasing force directs the sheet to the registration position. Sensors 200 may be disposed on or adjacent to the registration walls 130, 140 to detect when the sheet 5 has reached the target registration position. The sensors 200 may be operably connected to the controller 190.

Figure 4:
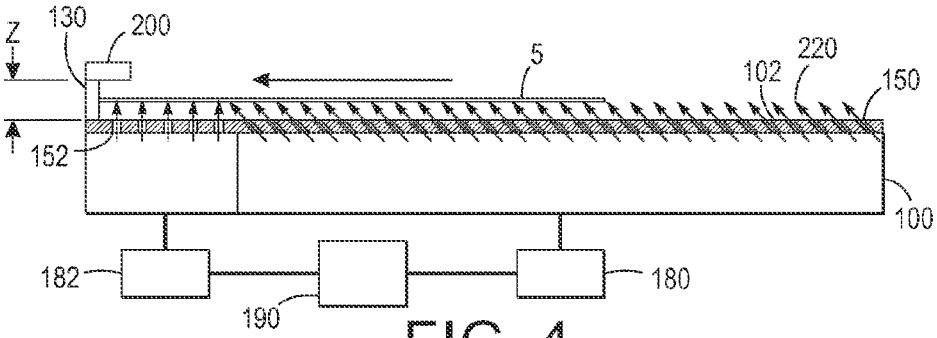
FIG. 4 is a side cross-sectional elevation view of the pneumatic table shown in FIG. 2 with positive airflow through a table media platen in accordance with an aspect of the disclosed technologies.
Figure 5:
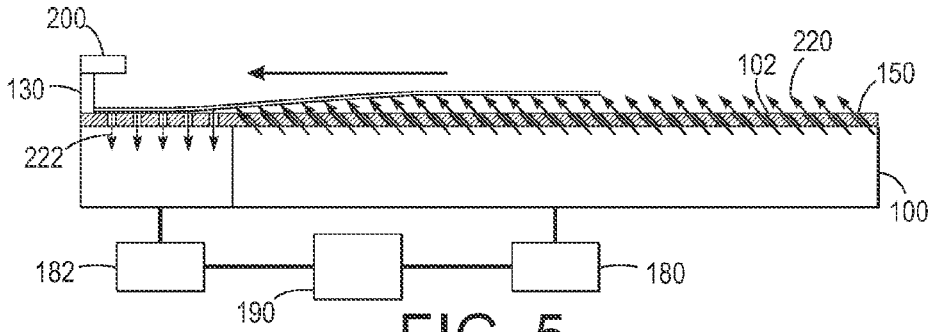
FIG. 5 is a side cross-sectional elevation view of the pneumatic table shown in FIG. 2 with a first set of holes having a positive airflow through the table and a second set of holes having a negative airflow through the table media platen in accordance with an aspect of the disclosed technologies.

Once the sheet 5 reaches the target registration position as shown in FIGS. 2 and 4, the sensors 200 signal the controller 190. With reference to FIG. 5, the controller 190 causes the second reversible air blower 182 operably connected to the second set of air holes 152 to switch from generating positive air flow to generating a vacuum force (also referred to herein as a negative air flow). Such negative air flow provides a suction force encouraging the portion of the substrate media sheet 5 above the second set of air holes 152 to be pulled straight down to foraminous upper surface 102 and is tacked in place. This is done with the vectored positive air flow still urging the sheet into the target registration position. Tacking a portion of the sheet down tends to hold the sheet in place and eliminates sheet drift. Once the edge of the sheet is tacked down, the first reversible air blower 180 operably connected to the first air holes 150 then will switch from generating positive air flow to generating a vacuum force. This vacuum clamps the entire sheet to the platen surface, and the sheet is securely held in place in a correctly registered position.

In and alternative embodiment shown in FIGS. 7-10, the first set of holes 150 and second set of holes 152 may be disposed in interlaced rows 210 with each other over the entire surface of the media platen 102. In order to urge the sheet to the registration position, the first set of holes 150 which are angled with respect to the platen surface 102 is filled with positive pressure. This creates a vectored airflow to float the sheet 5 into the registration position. When the sensors 200 determine that the sheet is in the registration position, the controller 190 causes the second blower 182 to generate a negative pressure through the second set of holes 152. The second set of holes 152 are aligned substantially perpendicular with respect to the platen surface 102 and are generally vertical. The positive pressure to the first set of holes 150 it turned off. The sheet 5 is then pulled down to the platen surface 102 and held in place at the registration position.

According to one aspect of the disclosed technologies, the switch between positive air flow and negative air flow can be a virtually instantaneous transition. Nonetheless, it is desirable that the transition be as quick as possible so that the substrate media sheet 5 stays in the target registration position and remains there when the negative air flow is applied. As a further alternative, the transition between positive and negative air flow can be provided progressively across the foraminous upper surface. In this way, some of the vectored first air holes 150 may be applying positive air flow to hold the sheet 5 in the registration position, when some of the straight vertical second air holes 152 are subject to negative air flow to tack the sheet down. After a portion of the sheet is tacked down, the positive pressure to the first set of air holes 150 is terminated and all of the second set of air holes 152 may be subjected to a negative pressure. This will cause the entire sheet to be pulled straight down to the platen surface 102 and held in the registration position.

With reference to FIGS. 1, 3 and 4, in operation, a sheet 5 is placed on the media platen 100. The sheet is initially not in the registration position. A positive air flow 220 is shown emitting from the upper surface 102 though both the first and second set of air holes. A gap Z between the sheet 5 and the upper surface 102 is filled with a gaseous layer causing the sheet 5 to float above the upper surface. The vectored air flow moves the sheet toward the registration position as shown in FIG. 4

Figure 6:
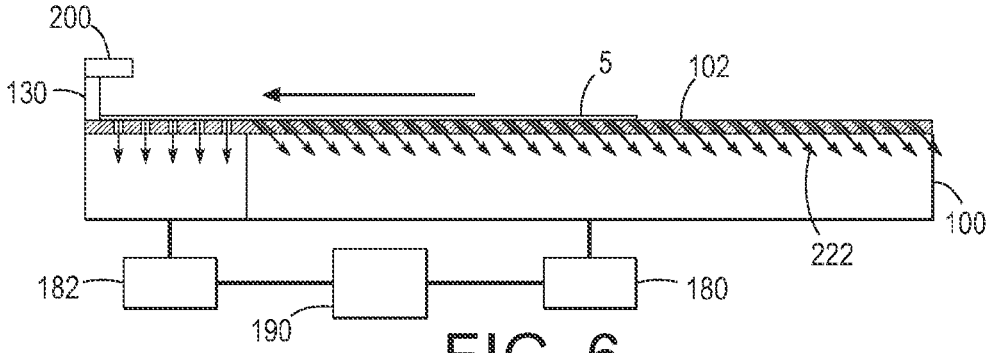
FIG. 6 is a side cross-sectional elevation view of the pneumatic table shown in FIG. 2 with negative airflow through the entire table media platen in accordance with an aspect of the disclosed technologies.
Figure 7:
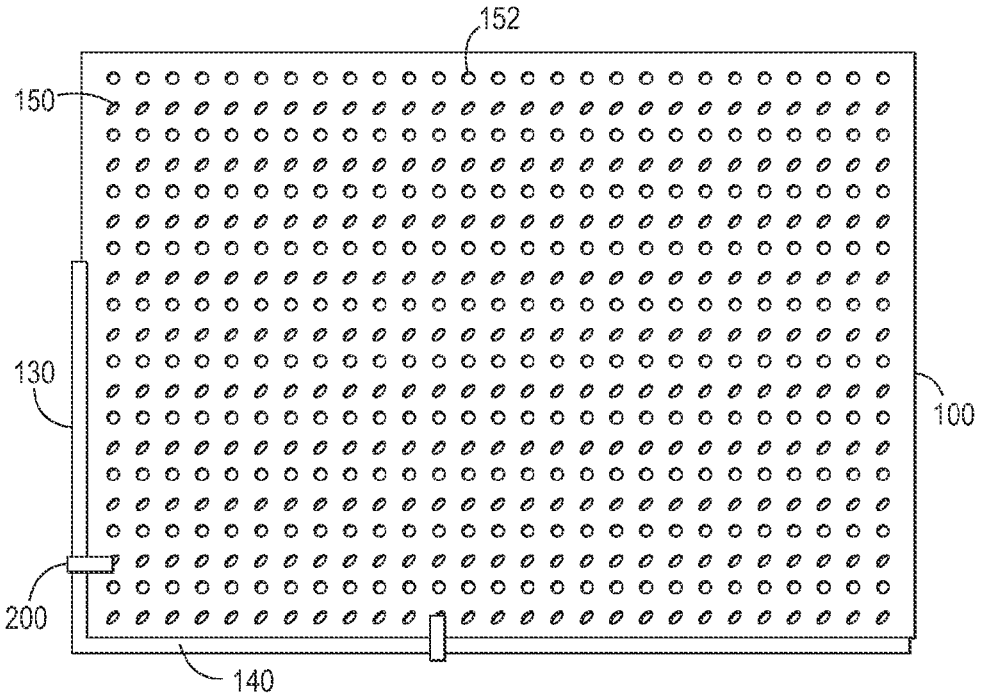
FIG. 7 is a partial plan view of a portion of the upper surface of an alternative embodiment of a pneumatic table in accordance with an aspect of the disclosed technologies.
Figure 8:
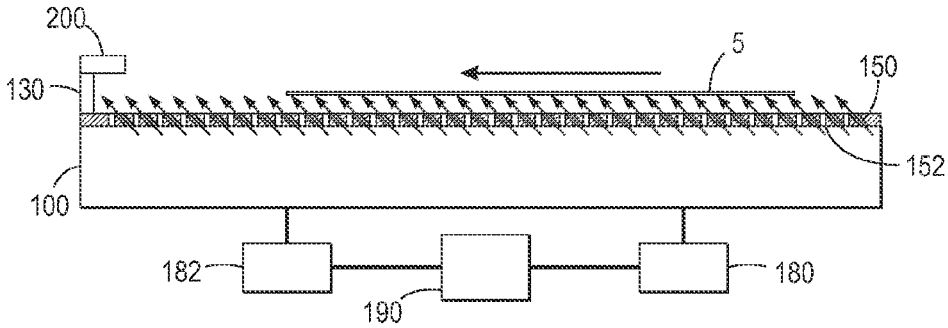
FIG. 8 is a side cross-sectional elevation view of the pneumatic table shown in FIG. 7 with positive airflow through the table media platen in accordance with an aspect of the disclosed technologies.
Figure 9:
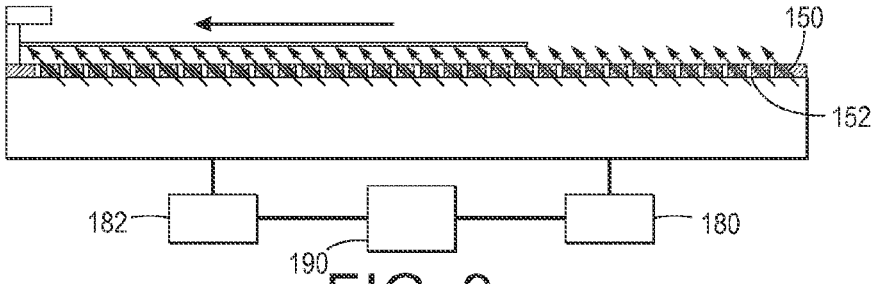
FIG. 9 is a side cross-sectional elevation view of the pneumatic table shown in FIG. 7 with positive airflow through the table media platen in accordance with an aspect of the disclosed technologies.

With reference to FIG. 5, when the sensors 200 detect the sheet is in registration position, the controller 190 causes the second blower to reverse and to start generating a negative airflow 222. This causes an edge of the sheet 5 to be pulled toward the surface and held in place. After a predetermined time, the controller 190 causes the first blower 180 to revise and generate a negative airflow 222 in the first set of holes 150. Therefore, a negative airflow is generated over the entire platen upper surface 102. This results in the remainder of the sheet being secured to the platen's surface 102 by vacuum as shown in FIG. 6. Once the sheet 5 is vacuum clamped in the target registration position, it is ready for marking or further processing by a printing system.

For the operation of the embodiment shown in FIGS. 7-10, a positive air flow 220 is shown emitting from the upper surface 102 though the first set of air holes 150. A gap Z between the sheet 5 and the upper surface 102 is filled with a gaseous layer causing the sheet 5 to float above the upper surface. The vectored air flow moves the sheet toward the registration position, FIG. 9.

Figure 10:
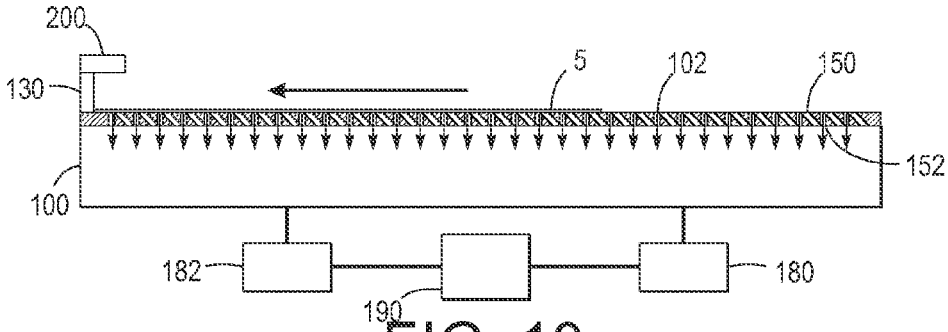
FIG. 10 is a side cross-sectional elevation view of the pneumatic table shown in FIG. 7 with negative airflow through the entire table media platen in accordance with an aspect of the disclosed technologies.

With reference to FIG. 10, when the sensors 200 detect the sheet is in registration position, the controller 190 causes the second blower to reverse and to start generating a negative airflow 222. This causes the sheet 5 to be pulled toward the surface 102. This occurs while positive air is being applied to the first set of air holes 150. After a predetermined time, the controller 190 causes the first blower to revise and generate a negative pressure. This results in the first set of air holes 150 generating a negative air pressure and the sheet is secured to the platen by vacuum as shown in FIG. 6. Once the sheet 5 is vacuum clamped in the target registration position, it is ready for marking or further processing by a printing system.

Further, the pneumatic table 10 can be carried by a media sled to a marking zone. In this way, a printing system, such as an inkjet assembly can mark the substrate sheet 5 as it passes. Alternatively and/or additionally, a variety of devices for generating an image could be used. For example, xerographic, flexographic or lithographic image transfer systems could be employed.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A pneumatic table for registering and clamping thereon a sheet of substrate media for handling in a printing system, the pneumatic table comprising:

a media platen, the media platen having a foraminous upper surface for receiving a substrate media sheet;

a first reversible air blower being in fluid communication with the media platen, the first reversible air blower selectively generating at least one of a positive air flow and a negative airflow through the foraminous upper surface, wherein the positive air flow forming a gaseous layer of air between the foraminous upper surface and the substrate media sheet, the negative airflow encouraging the substrate media sheet to remain fixed and engaged upon the foraminous upper surface;

a registration wall extending along at least one edge of the foraminous upper surface; and a sheet biasing element including a first set of angled holes extending through the media platen, the first set of angled holes providing a directionally vectored positive air flow, the sheet biasing element selectively applying a biasing force to the substrate media sheet encouraging movement of the substrate media sheet across the foraminous upper surface for engaging the substrate media sheet with the registration wall, and wherein the media platen includes a second set of air holes each having generally an orientation for directing an air flow substantially perpendicular to the platen surface, the second set of air holes being in fluid communication with a second reversible air first blower.

2. The pneumatic table as defined in claim 1, wherein the first reversible air blower is configured to provide a virtually instantaneous transition from positive air flow to negative air flow.

3. The pneumatic table as defined in claim 1, further comprising:

an edge sensor for detecting a position of the substrate media sheet, the edge sensor disposed along a portion of the registration wall for detecting whether the substrate media sheet has attained a target registration position.

4. The pneumatic table as defined in claim 1, wherein the registration wall extends along two adjoining edges of the foraminous upper surface.

5. The pneumatic table as defined in claim 1, wherein the registration wall extends continuously along the at least one edge substantially as long as at least one edge of the substrate media sheet.

6. The pneumatic table as defined in claim 1, wherein the first set of angled holes are in fluid communication with the first reversible air blower.

7. The pneumatic table as defined in claim 1, wherein the holes of the first set of holes are each aligned to direct air flow toward the registration wall.

8. The pneumatic table as defined in claim 7, wherein the second set of holes are disposed adjacent to the registration wall.

9. The pneumatic table as defined in claim 7, wherein the first set of holes and the second set of holes are interlaced with each other over a substantial portion of the media platen.

10. The pneumatic table as defined in claim 1, wherein a positive air flow is provided to the first set of air holes and simultaneously a negative air flow is provided to the second set of air holes.

11. The pneumatic table as defined in claim 1, wherein the first and second set of holes have a diameter in the range of 0.5 mm to 4 mm and a hole density generally in the range of 1 to 10 per $cm^2$.

12. A method of registering and securing a sheet of substrate media on a media platen for handling in a printing system, the method comprising:

loading a substrate media sheet onto a media platen, the media platen including a foraminous upper surface for engaging the substrate media sheet;

generating a positive flow of air through the foraminous upper surface, the positive flow of air forming a gaseous layer of air between the foraminous upper surface and the substrate media sheet;

applying a generally biasing force to the substrate media sheet at least partially suspended on the gaseous layer, the biasing force including a directionally vectored positive air flow passing through a first set of angled holes extending through the media platen; and generating a negative flow of air through the foraminous upper surface, the negative flow of air encouraging the substrate media sheet to remain fixed and engaged upon the foraminous upper surface, and wherein the media platen includes a second set of holes having a generally vertical orientation for directing an air flow substantially perpendicular to the platen surface.

13. The method as defined in claim 12, wherein in response to the sheet reaching a predetermined position, applying a negative pressure to the second set of holes to develop the negative flow of air to draw a portion of the sheet to the platen.

14. The method as defined in claim 13, applying a negative pressure to the first set of holes to draw a remainder of the sheet to the platen after.

15. The method as defined in claim 12, wherein the second set of holes are located on a portion of the platen separate and distinct from the first set of holes.

16. The method as defined in claim 12, wherein the second set of holes are interlaced with the first set of holes.

17. The method as defined in claim 12, wherein the negative flow of air is generated in response to an indication by a sensor that the substrate media sheet has engaged a registration wall extending along at least one edge of the foraminous upper surface.

18. A pneumatic table for registering and clamping thereon a sheet of substrate media for handling in a printing system, the pneumatic table comprising:

a media platen, the media platen having a foraminous upper surface for receiving a substrate media sheet, the media platen having a first and a second set of holes which have a diameter in the range of 0.5 mm to 4 mm and a hole density generally in the range of 1 to 10 per $cm^2$;

a first reversible air blower being in fluid communication with the media platen, the first reversible air blower selectively generating at least one of a positive air flow and a negative airflow through the foraminous upper surface, wherein the positive air flow forming a gaseous layer of air between the foraminous upper surface and the substrate media sheet, the negative airflow encouraging the substrate media sheet to remain fixed and engaged upon the foraminous upper surface;

a registration wall extending along at least one edge of the foraminous upper surface; and a sheet biasing element including a directionally vectored positive air flow, the sheet biasing element selectively applying a biasing force to the substrate media sheet encouraging movement of the substrate media sheet across the foraminous upper surface for engaging the substrate media sheet with the registration wall.

* * * * *